United States Patent [19]

Ishida

[11] Patent Number: 4,541,373

[45] Date of Patent: Sep. 17, 1985

[54] OIL LASH ADJUSTER

[75] Inventor: Yoich Ishida, Niiza, Japan

[73] Assignee: Honda Giken Kogyo Kabushiki Kaisha, Tokyo, Japan

[21] Appl. No.: 668,123

[22] Filed: Nov. 5, 1984

[30] Foreign Application Priority Data

| | | | |
|---|---|---|---|
| Nov. 4, 1983 | [JP] | Japan | 58-207258 |
| Mar. 29, 1984 | [JP] | Japan | 59-61889 |
| Mar. 29, 1984 | [JP] | Japan | 59-61890 |
| Mar. 29, 1984 | [JP] | Japan | 59-61891 |

[51] Int. Cl.[4] ..... F01L 1/24

[52] U.S. Cl. ..... 123/90.55; 123/90.46; 123/90.59

[58] Field of Search ..... 123/90.55, 90.57, 90.58, 123/90.59, 90.46

[56] References Cited

U.S. PATENT DOCUMENTS

| | | | |
|---|---|---|---|
| 2,526,593 | 10/1950 | Voorhies | 123/90.59 |
| 2,547,798 | 4/1951 | Truxell, Jr. | 123/90.59 |
| 2,553,756 | 5/1951 | Engemann | 123/90.59 |
| 2,654,356 | 10/1953 | Oldberg | 123/90.59 |
| 2,873,729 | 2/1959 | Van Slooten | 123/90.59 |
| 2,925,074 | 2/1960 | Dadd | 123/90.59 |
| 4,387,675 | 6/1983 | Hori et al. | 123/90.58 |

*Primary Examiner*—Ira S. Lazarus

*Attorney, Agent, or Firm*—Pollock, Vande Sande & Priddy

[57] ABSTRACT

A sealed type oil rush adjuster for the valve of a 4-cycle engine, having a liquid seal formed of a diaphragm which is mounted over the outer surface of the plunger, partitioning off a reservoir chamber. The diaphragm is pressure fitted by means of a perforated retainer plate having a flange which extends downwardly beyond the lower edge of the diaphragm and is pressed directly against the plunger body.

8 Claims, 7 Drawing Figures

OIL LASH ADJUSTER

FIELD OF THE INVENTION

The present invention relates to a sealed type of oil lash adjuster for the valve of a 4-cycle engine, particularly of the oil pressure operated kind.

BACKGROUND OF THE INVENTION

An oil lash adjuster makes use both of elastic material and oil pressure to achieve zero lash operation in a valve system. It has the advantage of being quiet in operation and maintenance free, and is hence employed in a variety of 4-cycle engines.

The lash adjuster disclosed in Japanese Pat. No. 54-142179 (1979) supports one end of a rocker arm which opens and closes the valve of a 4-cycle engine. A valve cam is positioned on the upper end of the rocker arm, and this enables zero lash operation of the valve system.

The lash adjuster according to this patent is composed of a cylindrical plunger body with a closed bottom, having a plunger sliding within it so as to create a high pressure chamber between the plunger and bottom of the plunger body. The elastic material of the plunger is retained within the plunger body by means of a snap ring which fits within an annular groove in the upper end of the interior surface of the plunger body, and prevents the plunger from being withdrawn upwardly.

The lash adjuster according to the above-mentioned patent will be described in more detail with reference to the drawings. It has the disadvantage that, while sufficient force is needed in order to secure the lower edge of the diaphragm to the plunger body, excessive force must be avoided because the diaphragm used is made of soft material between the plunger body and a metal retainer which is pressure fitted.

In a further embodiment of the prior art structure, an annular groove is formed in the upper portion of the outer surface of the plunger body, and the diaphragm is provided with an annular projection, also of soft material, which fits into that groove. Because of the softness of this projection, the structure is not securely attached together.

OBJECT OF THE INVENTION

The present invention is intended to overcome the disadvantages of the prior art structures, and has the object of providing a sealed type of oil pressure lash adjuster which has a firm and secure pressure fit between the bottom edge of the diaphragm and the outer surface of the plunger body.

BRIEF DESCRIPTION OF THE DRAWINGS

In order that the invention may be more clearly understood, reference will now be made to the accompanying drawings, in which several embodiments of the invention are illustrated by way of example, and in which.

DESCRIPTION OF PREFERRED EMBODIMENT

Figure 1:
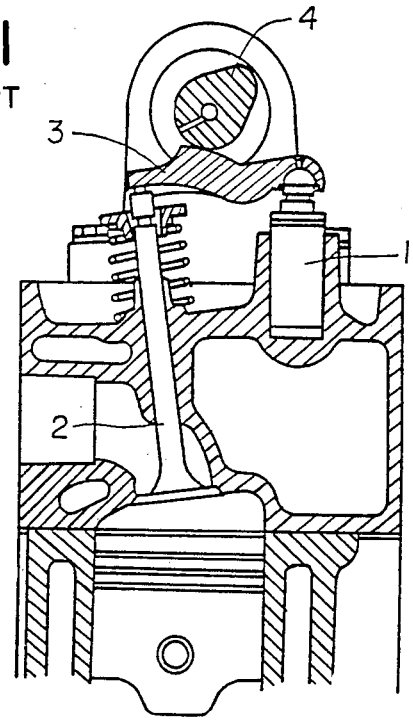
FIG. 1 PRIOR ART
FIG. 1 is a schematic front elevation of a valve operating system incorporating a prior art lash adjuster.
Figure 2:
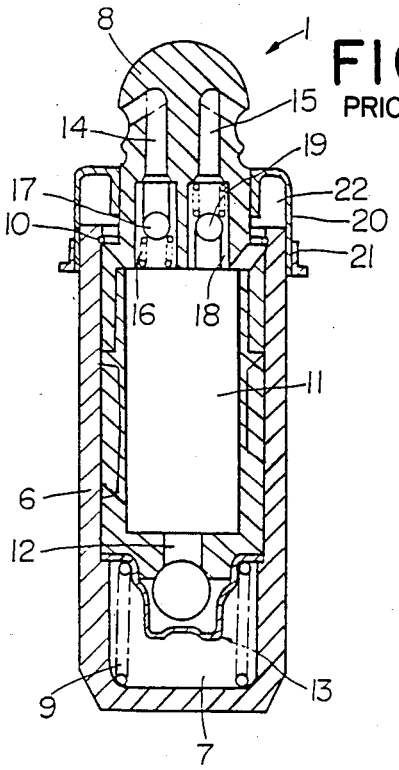
FIG. 2 PRIOR ART
FIG. 2 is a vertical cross section of the prior art lash adjuster shown in FIG. 1.

As shown in FIGS. 1 and 2, which relate to a prior art structure, lash adjuster 1 is composed of a cylindrical plunger body 6 closed at the bottom and having a plunger 8 slidable therein so as to create a high pressure chamber 7 between the plunger and the bottom of the plunger body. The elastic material 9 of the plunger is retained within the plunger body by means of a snap ring 10 which prevents the plunger from being withdrawn upwardly because it is fitted in an annular groove **6*a*** in the upper end of the inner surface of the plunger body.

Plunger 8 is supported within a semi-circular annular head formed on one end of a rocker arm 3, and has an interior reservoir chamber 11 which is connected by a passage 12 in the bottom of the plunger to high pressure chamber 7. A check valve 13 is the opening of passage 12 on the high pressure chamber side prevents the flow of operating oil except for that which flows from reservoir chamber 11 to high pressure chamber 7.

Additional passages 14 and 15 in plunger 8 permit flow from reservoir chamber 11 to the exterior. One of these passages (14) is provided with a check ball 17 at its upper part made of elastic material 16, which the other passage (15) is provided with a check ball 19 at its lower part made of elastic material 18. These maintain the pressure within reservoir chamber 11 within predetermined limits.

A substantially cylindrical diaphragm 20 made of a soft material is disposed on the outer circumference of the plunger body 6 near its top, one edge of this diaphragm being retained on this outer circumference by means of an annular metal retainer 21 which is press fitted so as to form a seal on the upper outside circumference of the plunger body. The other edge of diaphragm 20 is attached and sealed tightly to the upper outer surface of plunger 8. This creates a sealed space 22 between the shoulder on plunger 8 and the inner surface of diaphragm 20. Space 22 is connected to reservoir chamber 11 by a passage 23.

With a lash adjuster of this type, when a gap tends to form between rocker arm 3 and valve cam 4, plunger 8 rises due to the action of elastic material 9 to close this gap. This upward movement causes the operating oil in reservoir chamber 11 to flow into high pressure chamber 7 through passage 12. At this point, force is applied to cam 4, and thence compressive force to lash adjuster 1. However, since check valve 13 prevents reverse flow of the operating oil, lash adjuster 1 remains greatly extended, and the action of cam 4 is transmitted to valve 2 via rocker arm 3. As cam 4 rises, a portion of the operating oil within high pressure chamber 7 flows into space 22 through the clearance between plunger body 6 and plunger 8 due to the shock which is imparted, and is then returned to reservoir chamber 11 via passage 23, which buffers the shock so as to facilitate quiet, stable operation.

As noted hereinabove, this structure has several disadvantages, arising from the fact that the diaphragm is made of a soft material, so that excessive force must be avoided in applying retainer 21, while considerable force is needed to secure the lower edge of the diaphragm to plunger body 6.

Figure 3:
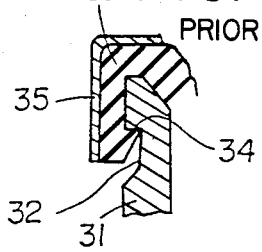
FIG. 3 PRIOR ART
FIG. 3 is a detail view of another prior art arrangement for attaching the diaphragm to the plunger body.

In the embodiment of the prior art device illustrated in FIG. 3, an annular groove 32 is formed in the upper portion of the outer surface of plunger body 31. Diaphragm 33 has an annular projection 34, of the same soft material, which fits into the groove. Further, the lower edge of diaphragm 33 is held against plunger body 31 by a pressed metal retainer 35. Because of the softness of projection 34, the attachment in groove 32 is not sufficiently secure.

In the present invention, as illustrated in FIGS. 4 to 7, high pressure chamber 42 is formed between the closed bottom of plunger body 41 and plunger 43 slidable therein. Plunger 43 is pulled upward by elastic material 44, and a retainer 45, to be described, prevents it from being pulled out completely.

Plunger 43 has large diameter areas 46 and 47 on its longitudinally lower and central sections, and these fit against the inner surface of plunger body 41 and are free to slide along it. An annular groove 48 is formed between these areas. The upper edge of plunger 43 abuts the lower edge of a rocker arm (not shown) in such manner that it is free to move via a hemispherical end portion. An annular space 49 between groove 48 and the inner surface of plunger body 41 is connected to high pressure chamber 42 by passage 50 in plunger 43. Passage 50, the upper part of which is closed by a plug 63, is provided with a reverse flow check valve 51 at its opening into high pressure chamber 42, so that the flow of operating oil is only possible toward the latter chamber.

The check valve is attached via snap ring 53 which holds ball cage 52 at the bottom of plunger 43, thereby partitioning high pressure chamber 42. Check ball 54 is contained inside this ball cage.

A substantially cylindrical diaphragm 55 is affixed to the outer surface of plunger 43 by a retainer 56 which clamps it so as to form a liquid-tight seal. The lower edge of diaphragm 55 is attached to the upper end of plunger body 41 by means of the above-mentioned retainer 45 to form a seal. Thus, a reservoir chamber 57 is formed between the inner surface of diaphragm 55 and the shoulder area of plunger 43. Reservoir chamber 57 is connected by passages 58 and 50 to space 49 and high pressure chamber 42.

Figure 5:
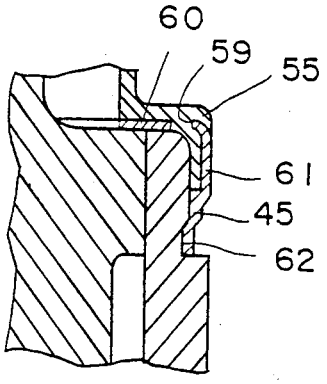
FIG. 5 is a detail view of the portion of FIG. 4 which is enclosed in a circle.
Figure 6:
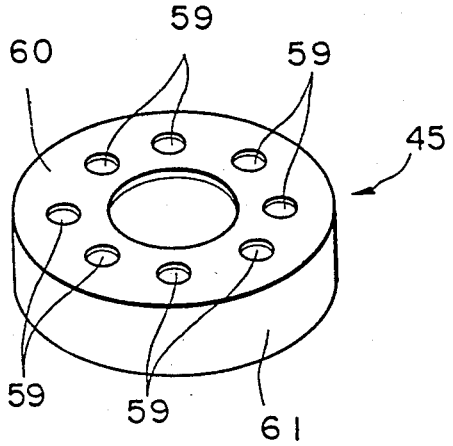
FIG. 6 is a perspective view of the retainer.

FIG. 5 shows the structure of the groove for attaching the lower edge of diaphragm 55 to plunger body 41. Retainer 45 comprises an annular plate 60 which has a plurality of holes 59 spaced around it in the circumferential direction, and a downwardly extending cylindrical flange 61. The lower end of a diaphragm 55 is attached to retainer 45 by means of adhesive so that it extends to the middle area of the inside surface of flange 61. The lower edge of retainer 45 is pressed and affixed to annular groove 62 which is formed in the small diameter outer surface of the upper end of plunger body 41.

In the lash adjuster which has been described, when a gap tends to form between the rocker arm of the valve system and the cam, elastic material 44 pulls plunger 43 so that it moves upwardly to close the gap. Accompanying the upward movement of plunger 43, the operating oil in reservoir chamber 57 flows into high pressure chamber 42 via passages 58 and 50. At this point, the force applied to the cam acts in such manner that, even if compression force is applied to the lash adjuster, reverse flow of the operating oil from the high pressure chamber is prevented by check valve 51, so that the total length of the lash adjuster is retained to exert on operating force on the cam transmitted via the rocker arm.

When plunger body 43 slides up and down relative to plunger body 41, the volume of the high pressure chamber changes, but this change is absorbed by the expansion and contraction of diaphragm 55.

Since retainer 45 extends below the lower edge of diaphragm 55 and is directly pressed against the plunger body, the necessary force can be applied to create a secure fit; this also produces a strong and firm bond between diaphragm 55 and the outer surface of plunger body 41.

As to leakage from high pressure chamber 42 to reservoir chamber 57 between plunger body 41 and plunger 43 in the area where they slide against one another, such leakage can take place only in the region below annular groove 48. In contrast to the prior art structure illustrated in FIG. 2, the sliding area is shorter in the present invention, so that the clearance between the plunger and the plunger body can be increased to obtain the desired degree of leakage without increasing resistance so much that the operation comes to a halt. This means that dropping of plunger 43 can be prevented while increasing the durability and operability of the device.

The structure according to the present invention permits retainer 45 which holds diaphragm 55 against plunger body 41 to function as a stopper, which prevents plunger 43 from falling out of the plunger body. This means that fewer parts are needed than in the prior art structure shown in FIGS. 2 and 3, and allows the entire lash adjuster to be reduced in size.

In the prior art structure shown in FIG. 2, plunger body has to be made long enough to accommodate annular groove *6a*, and a special stopper element, i.e., snap ring 10, must be provided.

Figure 4:
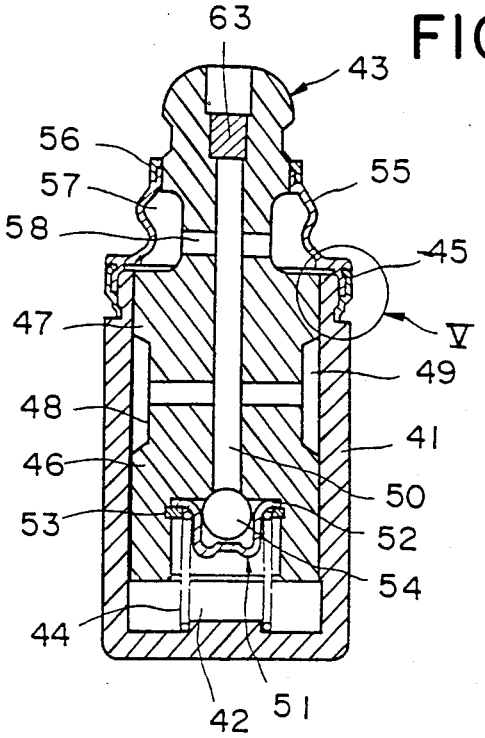
FIG. 4 is a vertical cross sectional view of a first embodiment of the present invention.

Further, in the embodiment of the present invention illustrated in FIGS. 4 and 5, holes 59 in retainer 45 allow the latter to expand and strengthen the seal which is made, so that there is no need for a separate sealing element. A good quality seal is also maintained between diaphragm 55 and plunger body 43. By contrast, in the prior art adjuster shown in FIG. 2, retainer 21 is simply pressed about the outer surface of diaphragm 20, so that the seal between the diaphragm and plunger body 6 is weak. Moreover, when diaphragm 20 is repeatedly deformed by expansion or compression, the outer surface of diaphragm 20 comes into contact with the upper edge of retainer 21, decreasing the longevity of the diaphragm.

In order to further strengthen the attachment between diaphragm 55 and plunger body 41, the portions 55*a* of diaphragm 55 protruding downwardly through holes 59 of annular plate 60 are joined together to unitize them. In addition, an adhesive can be used between the lower edge of diaphragm 55 and retainer 45 in order to strengthen the bond betweem them. As a further alternative, holes 59 could be located in flange portion 61 of retainer 45, rather than in plate portion 60.

Figure 7:
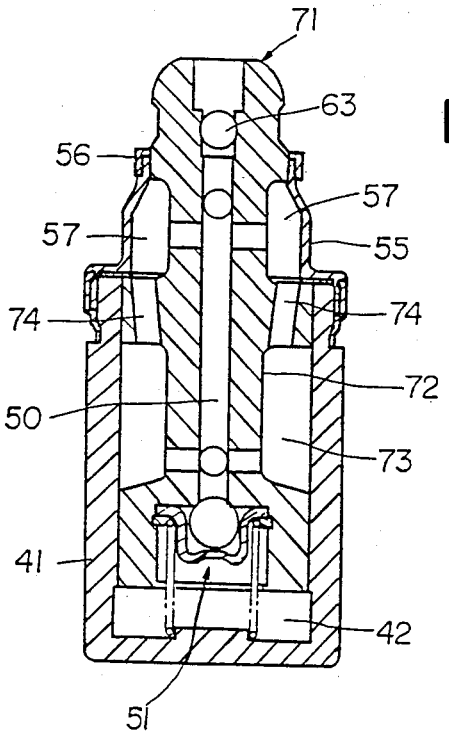
FIG. 7 is a vertical cross section view of a second embodiment of the present invention.

FIG. 7 shows another embodiment of the present invention, in which there is greater depth to the annular groove 72 in the sliding surface of plunger 71. Also, a passage 74 allows a flow from chamber 73 in plunger 71 to reservoir chamber 57. By making this space larger, more operating oil can be accommodated, thereby increasing the heat capacity of all of the operating oil. This means that temperature changes in the operating oil can be held to a minimum for more reliable operation of plunger 71. This is also desirable because it helps prevent degradation of the operating oil.

The annular groove need not be located around the plunger in the area where it slides against the plunger body, but may equally well be located in the latter.

What is claimed is:

1. A sealed type of oil lash adjuster, comprising (a) a cylindrical plunger body having a closed bottom;

(b) a plunger projecting from the top of said plunger body and slidable therewithin to form a high pressure chamber between said bottom of said plunger body and a bottom surface of said plunger;

(c) said high pressure chamber being connected via a reverse check valve with a reservoir chamber;

(d) a substantially cylindrical diaphragm with an upper edge inserted to form a liquid seal on the outer surface of said plunger, partitioning off said reservoir chamber on the inside;

(e) A lower edge of said diaphragm being pressure seated to form a liquid seal on the outer surface of the upper part of said plunger body by means of a retainer about the exterior of said diaphragm;

(f) a lower edge of said retainer projecting downward beyond the lower edge of said diaphragm and being directly pressed and held against said plunger body.

2. An oil lash adjuster according to claim 1, wherein said lower edge of said diaphragm extends through a plurality of holes in said retainer, so that it projects to the interior of said retainer, its projecting portions being joined, and said retainer being pressure fitted to said upper external surface of said plunger body.

3. An oil lash adjuster according to claim 1, comprising an annular plate unitized with said retainer which restricts the upward movement of said plunger.

4. An oil lash adjuster according to claim 2, comprising an annular plate unitized with said retainer which restricts the upward movement of said plunger.

5. An oil lash adjuster according to claim 1, comprising a circumferential groove on the mutually facing sliding surface of one of said plunger body and said plunger.

6. An oil lash adjuster according to claim 2, wherein said retainer comprises a substantially circular plate portion with a substantially cylindrical downwardly extending flange.

7. An oil lash adjuster according to claim 6, wherein said holes are substantially evenly spaced about the periphery of said plate portion.

8. An oil lash adjuster according to claim 6, wherein said holes are substantially evenly spaced about said flange portion.

* * * * *